US008702872B2

(12) United States Patent
Käske

(10) Patent No.: US 8,702,872 B2
(45) Date of Patent: Apr. 22, 2014

(54) DEVICE AND PROCESS FOR GENERATING A PULSED JET OF A LIQUID FLUID

(71) Applicant: Dürr Ecoclean GmbH, Filderstadt (DE)

(72) Inventor: Egon Käske, Aachen (DE)

(73) Assignee: Dürr Ecoclean GmbH, Filderstadt (DE)

( * ) Notice: Subject to any disclaimer, the term of this patent is extended or adjusted under 35 U.S.C. 154(b) by 45 days.

(21) Appl. No.: 13/648,835

(22) Filed: Oct. 10, 2012

(65) Prior Publication Data

US 2013/0037064 A1 Feb. 14, 2013

Related U.S. Application Data

(60) Division of application No. 13/022,339, filed on Feb. 7, 2011, now abandoned, which is a continuation of application No. PCT/EP2009/053968, filed on Apr. 2, 2009.

(30) Foreign Application Priority Data

Aug. 9, 2008 (DE) ..... 10 2008 037 247

(51) Int. Cl.
*B08B 3/02* (2006.01)

(52) U.S. Cl.
USPC ..... 134/34; 134/22.18

(58) Field of Classification Search
USPC ..... 134/22.18, 34, 36
See application file for complete search history.

(56) References Cited

U.S. PATENT DOCUMENTS 3,590,775 A 7/1971 Barr
4,422,882 A 12/1983 Nelson et al.
5,397,054 A 3/1995 Ziegs
5,890,502 A 4/1999 Huh et al.
6,343,927 B1 2/2002 Eroglu et al.

(Continued)

FOREIGN PATENT DOCUMENTS

DE 4328382 3/1994
DE 19528033 2/1997

(Continued)

OTHER PUBLICATIONS

International Searching Authority, "Written Opinion" issued in connection with International Application No. PCT/EP2009/053968, and it's English translation, mailed Jul. 6, 2009, 10 pages.

International Searching Authority, "International Search Report" issued in connection with International Application No. PCT/EP2009/053968, mailed Jul. 6, 2009, 3 pages.

(Continued)

*Primary Examiner* — Michael Barr
*Assistant Examiner* — Caitlin N Dunlap
(74) *Attorney, Agent, or Firm* — Hanley, Flight & Zimmerman, LLC.

(57) ABSTRACT

In order to provide a device for generating a pulsed jet of a liquid fluid comprising a fluid inlet, a fluid outlet and a blocking element arranged between the fluid inlet and the fluid outlet, which cyclically closes and opens a fluid passage between the fluid inlet and the fluid outlet, which device enables an improved mechanical action on an object subjected to the pulsed jet, it is proposed that the device comprises at least one bypass, through which a liquid fluid can also be fed to the fluid outlet during a closing phase of the blocking element.

16 Claims, 9 Drawing Sheets

(56) References Cited

U.S. PATENT DOCUMENTS

| | | | | |
|---|---|---|---|---|
| 6,444,090 | B1 | 9/2002 | Wolf et al. | |
| 6,962,169 | B2 | 11/2005 | Kaske | |
| 2004/0221900 | A1 | 11/2004 | Kaske | |
| 2008/0048048 | A1* | 2/2008 | Noestheden | 239/101 |
| 2011/0168216 | A1 | 7/2011 | Kaske | |

FOREIGN PATENT DOCUMENTS

| | | |
|---|---|---|
| DE | 19934612 | 1/2001 |
| DE | 29924880 | 8/2006 |
| EP | 0255947 | 2/1988 |
| EP | 1854557 | 5/2007 |
| GB | 2109271 | 6/1983 |
| GB | 2112303 | 7/1983 |
| GB | 2112304 | 7/1983 |
| WO | 03036144 | 5/2003 |

OTHER PUBLICATIONS

German Patent Office, "Search Report," issued in connection with German Patent Application No. 10 2008 037 247.1, dated May 28, 2009, and its English Translation, 5 pages.

United States Patent and Trademark Office, "Final Office Action," issued in connection with U.S. Appl. No. 13/022,339, dated Jul. 11, 2012, 20 pages.

United States Patent and Trademark Office, "Non-Final Office Action," issued in connection with U.S. Appl. No. 13/022,339, dated Jan. 20, 2012, 20 pages.

United States Patent and Trademark Office, "Restriction Requirement," issued in connection with U.S. Appl. No. 13/022,339, dated Sep. 14, 2011, 7 pages.

China Intellectual Property Office,"0ffice Action" issued in connection with Chinese Application No. 200980130853.4, dated Mar. 21, 2013 (English Translation included),14 pages.

* cited by examiner

DEVICE AND PROCESS FOR GENERATING A PULSED JET OF A LIQUID FLUID

RELATED APPLICATION

This patent arises from a divisional of U.S. patent application Ser. No. 13/022,339 filed Feb. 7, 2011, which is a continuation of International Patent Application No. PCT/EP2009/053968 filed Apr. 2, 2009, which claims priority to German Patent Application No. 10 2008 037 247.1, filed Aug. 9, 2008, each of which are hereby incorporated herein by reference in their entireties.

FIELD OF DISCLOSURE

The present invention relates to a device for generating a pulsed jet of a liquid fluid, comprising a fluid inlet, a fluid outlet and a blocking element arranged between the fluid inlet and the fluid outlet, which cyclically closes and opens a fluid passage between the fluid inlet and the fluid outlet.

BACKGROUND

Such a device is known, for example, from patent document WO 03/036144 A1.

In the case of the known device a jet flowing out of the fluid outlet is cyclically completely interrupted.

SUMMARY OF THE INVENTION

The object forming the basis of the present invention is to provide a device for generating a pulsed jet of a liquid fluid, which allows an improved mechanical action on an object subjected to the pulsed jet.

This object is achieved according to the invention in that the device comprises at least one bypass, through which a liquid fluid can also be fed to the fluid outlet during a closing phase of the blocking element.

The mechanical action of the pulsed jet is improved because a liquid fluid can also be fed to the fluid outlet and thus to the object to be subjected to the jet during a closing phase of the blocking element.

In a preferred configuration of the invention it is provided that the device comprises an adjusting device for adjusting a volume flow of a bypass fluid flow flowing through the bypass.

It is advantageous if the device comprises a control device for controlling the volume flow of the bypass fluid jet flowing through the bypass.

It is particularly advantageous if the device comprises a regulating device for regulating the bypass fluid flow flowing through the bypass.

Alternatively or additionally hereto, it can be provided that the device comprises an adjusting device, an open-loop control device and/or a closed-loop control device for adjusting, controlling or regulating a pressure of the bypass fluid flow flowing through the bypass.

It is favourable if the device comprises an adjusting device for adjusting a volume flow of a pulsed fluid flow flowing through the fluid passage.

It is particularly favourable if the device comprises a control device for controlling the volume flow of the pulsed fluid flow flowing through the fluid passage.

It is advantageous if the device comprises a regulating device for regulating the volume flow of the pulsed fluid flow flowing through the fluid passage.

To enable the pulsed fluid flow flowing through the fluid passage to be easily adjusted, controlled and/or regulated, it is advantageous if a closing time, an open time and/or an opening frequency of the blocking element can be adjusted, controlled and/or regulated.

In this description and in the attached claims an opening frequency should be understood to mean the number of open phases of the blocking element per unit time.

In addition, it can be provided that the device comprises an adjusting device, an open-loop control device and/or a closed-loop control device for adjusting, controlling or regulating a pressure of the pulsed fluid flow flowing through the fluid passage.

In a further development of the invention it can be provided that a total fluid flow flowing through the device can be divided into a pulsed fluid flow flowing through the fluid passage and a bypass fluid flow flowing through the bypass so that a volume flow of the bypass fluid flow amounts to approximately 10% at most of a volume flow of the total fluid flow.

It is advantageous if the blocking element is configured such that it is operable with an opening frequency of at least approximately 2 Hz.

It is favourable if the blocking element has a rotatable configuration. The opening frequency is then double the rotation frequency of the blocking element.

In order to generate a pulsed jet, which pulsates at as constant a frequency as possible, it is favourable if the device comprises a rotary drive for the blocking element, in particular with rotational speed that can be adjusted, controlled and/or regulated.

Such a rotary drive is preferably configured as a pneumatic, hydraulic or electric rotary drive.

It has proved favourable in practice if the blocking element is configured such that it is operable with an opening frequency of approximately 200 Hz at most.

It is favourable if the device comprises a pump for driving a flow of a fluid through the device.

It is particularly favourable if the fluid flowing through the device can be subjected to a predetermined pressure by means of a pump.

In a configuration of the invention it is provided that the fluid flowing through the device can be subjected to a pressure of at least approximately 3 bar.

It is additionally favourable if the fluid flowing through the device can be subjected to a pressure of approximately 300 bar at most.

In a configuration of the invention it is provided that a fluid connection is formed between the fluid inlet and the fluid outlet by means of the bypass. As a result, fluid can also be fed to the fluid outlet in a particularly simple manner during the closing phases of the blocking element.

The device preferably comprises a damping element for reducing pressure peaks occurring in the closing phase of the blocking element in the device for generating a pulsed jet of a liquid fluid.

It is favourable if the damping element is arranged downstream of a pump in a direction of flow, in which the fluid flows through the device. Pressure peaks generated by means of the pump can be easily damped in this way.

It is particularly favourable if the damping element is arranged upstream of the blocking element in the direction of flow. Pressure peaks occurring at the blocking element can be easily damped as a result of this.

In a configuration of the invention it is provided that the damping element is at least partially filled with a compressible fluid in an operating state of the device. As a result, pressure peaks occurring in the device can be easily reduced by means of the damping element.

It is particularly favourable if the damping element is at least partially filled with a gaseous fluid in an operating state of the device. The damping of the damping element can then be specifically adjusted in particular by the choice of the gas pressure and the amount of gas.

Alternatively or additionally hereto, it can be provided that the damping element is formed at least in sections from an elastic material.

For example, it can be provided that up to a predetermined limit pressure damping of the damping element substantially occurs as a result of the compression of gas contained therein and that with a pressure above the limit pressure, for the prevention of possible damages to the device, for example, a deformation of an elastic region of the damping element occurs.

In a preferred configuration of the invention it is provided that the device comprises at least two fluid outlets and at least two blocking elements, wherein during operation of the device a first blocking element cyclically closes and opens a first fluid passage, so that a first pulsed jet of a liquid fluid can be generated at a first fluid outlet, and wherein during operation of the device a second blocking element cyclically closes and opens a second fluid passage, so that a second pulsed jet of a liquid fluid can be generated at a second fluid outlet. A workpiece to be cleaned can be subjected to two pulsed jets of a liquid fluid, for example, as a result of this.

A simple structure of the device is assured in particular when liquid fluid of the same type is used for all jets. However, alternatively hereto it can also be provided that liquid fluids of different types are used for different jets.

It is favourable if the device can be operated so that the closing and open phases of the first blocking element are staggered in time in relation to the closing and open phases of the second blocking element.

It can be provided in particular that the device can be operated so that the closing phases of the first blocking element substantially coincide in time with the open phases of the second blocking element and the open phases of the first blocking element substantially coincide in time with the closing phases of the second blocking element.

The device can preferably be operated so that no time overlap occurs between the open phases of the first blocking element and the open phases of the second blocking element.

The closing and open phases of the first blocking element can be staggered in time in relation to the closing and open phases of the second blocking element in a simple manner in particular when the at least two blocking elements are coupled to one another.

In a further development of the invention it is provided that the device comprises a common drive for driving at least two blocking elements or at least two drives synchronised to one another for driving at least two blocking elements.

In the case where the device comprises a common drive for driving at least two blocking elements, the at least two blocking elements are preferably coupled to the common drive so that during operation of the device the closing and open phases of the first blocking element are staggered in time in relation to the closing and open phases of the second blocking element.

In the case where the device comprises at least two drives for the at least two blocking elements, in particular a separate drive for each blocking element, the at least two drives are preferably synchronised to one another so that during operation of the device the closing and open phases of the first blocking element are staggered in time in relation to the closing and open phases of the second blocking element.

The device preferably comprises at least two bypasses, wherein a liquid fluid can also be fed to the first fluid outlet through a first bypass during a closing phase of the first blocking element and wherein a liquid fluid can also be fed to the second fluid outlet through a second bypass during a closing phase of the second blocking element.

A further object forming the basis of the present invention is to provide a process for generating a pulsed jet of a liquid fluid, which enables an improved mechanical action on an object subjected to the pulsed jet, in particular on a workpiece.

This object is achieved according to the invention by a process for subjecting a workpiece to a pulsed jet of a liquid fluid, wherein the process comprises the following process steps:

- generating pulses of the pulsed jet by cyclically interrupting a fluid flow through a fluid passage;
- subjecting the workpiece to the pulses of the pulsed jet;
- subjecting the workpiece to a bypass fluid flow of the fluid also during the cyclical interruptions of the fluid flow through the fluid passage.

The process for subjecting a workpiece to a pulsed jet of a liquid fluid preferably has the features and advantages described above in association with the device according to the invention.

In one development of the process it is provided that pressure peaks occurring during the cyclical interruptions of the fluid flow through the fluid passage are reduced by means of a damping element.

It is favourable if the workpiece is subjected to at least one further pulsed jet of a liquid fluid.

It is particularly favourable if the pulses of a first pulsed jet are staggered in time in relation to the pulses of a second pulsed jet.

It can be provided in particular in this case that the time of the outflow of the pulses of a first pulsed jet at the first fluid outlet is staggered in time in relation to the time of the outflow of the pulses of a second pulsed jet at a second fluid outlet.

It can be provided in particular that the workpiece is alternately subjected to pulses of a first pulsed jet and to pulses of a second pulsed jet.

It is favourable if a pulse frequency of the first pulsed jet corresponds at least approximately to a pulse frequency of the second pulsed jet.

It can be provided that the workpiece is subjected to liquid fluid with a first pulsed jet from a first direction and with a second pulsed jet from a second direction different from the first direction.

It is advantageous if the outflow direction of the first pulsed jet from the first fluid outlet is opposed at least approximately to the outflow direction of the second pulsed jet from the second fluid outlet.

In a configuration of the invention it is provided that a cavity of the workpiece is alternately subjected to the pulses of a first pulsed jet of a liquid fluid flowing through a first access opening of the cavity and to the pulses of a second pulsed jet of a liquid fluid flowing through a second access opening of the cavity.

In this way, contaminants adhering in the cavity of the workpiece, for example, cuttings formed during machining of the workpiece, in particular cuttings in confined spaces of cylinder heads, for example, can be easily loosened and removed from the cavity of the workpiece.

It can be provided in this case, for example, that the first pulsed jet is directed towards the first access opening and the second pulsed jet is directed towards the second access opening.

It is assured that the cavity of the workpiece is subjected to fluid in an especially reliable manner in particular when the first fluid outlet is introduced into the cavity through the first access opening and the second fluid outlet is introduced into the cavity through the access opening.

In a further development of the invention it is provided that a region of a cavity of the workpiece is subjected to the pulses of a first pulsed jet of a liquid fluid and to the pulses of a second pulsed jet of a liquid fluid in such a manner that the fluid from the first pulsed jet and the fluid from the second pulsed jet flow through the region of the cavity of the workpiece in different directions.

The fluid flowing out of the first pulsed jet and the fluid flowing out of the second pulsed jet preferably flow through the region of the cavity of the workpiece in opposing directions.

It is assured that the region of the cavity of the workpiece is subjected to fluid in an especially advantageous manner in particular when the region of the cavity of the workpiece is alternately subjected to pulses of the first pulsed jet of a liquid fluid and to pulses of the second pulsed jet of a liquid fluid.

The device according to the invention is particularly suitable for cleaning a workpiece, wherein the process according to the invention is preferably conducted.

The fluid flowing through the device preferably comprises a cleaning liquid.

It is particularly preferred that the device according to the invention is used for cleaning cavities of workpieces, e.g. of cylinder heads and crankcases, since the workpieces are also subjected to fluid during closing phases of the blocking element and no air that diminishes the cleaning action of the pulsed jet can pass into the workpiece.

In general, the workpiece can be enclosed by a gas or gas mixture or by a liquid, e.g. a cleaning liquid.

Moreover, it can be provided that a cleaning operation of the workpiece occurs in a low-pressure atmosphere (below atmospheric pressure).

Further features and advantages of the invention are the subject of the following description and the representation of exemplary embodiments in the drawings.

BRIEF DESCRIPTION OF THE DRAWINGS

The same or functionally equivalent elements are given the same reference numbers in all the figures.

DETAILED DESCRIPTION OF THE INVENTION

Figure 1:
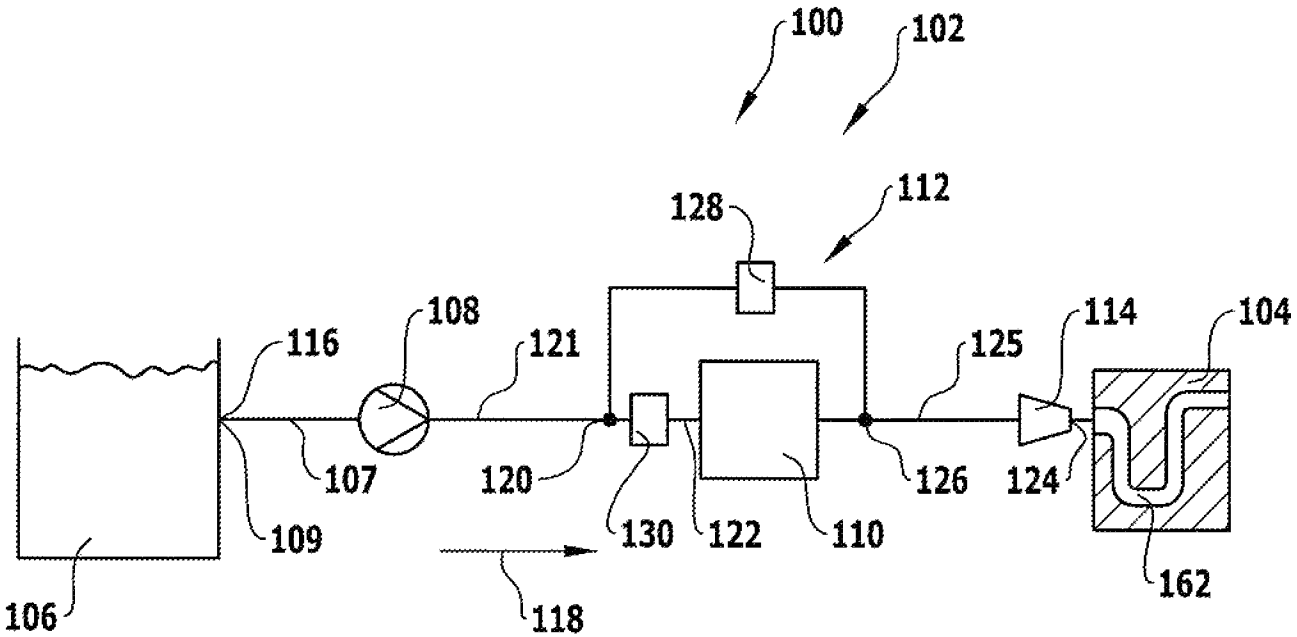
FIG. 1 is a schematic representation of a first embodiment of a device for generating a pulsed jet of a liquid fluid.

A device for generating a pulsed jet of a liquid fluid (hereafter referred to as "jet generating device") shown schematically in FIG. 1 and given the overall reference 100 is configured as a cleaning device 102 for cleaning a workpiece 104.

The cleaning device 102 comprises a fluid container 106, a pump 108, a pulse valve 110, a bypass 112 and a nozzle 114.

The fluid container 106 is filled with a liquid cleaning fluid, for example, and serves as storage container for fluid flowing through the cleaning device 102.

The fluid container 106 has a fluid connection to the pump 108 by means of a suction pipe 107.

A fluid inlet 109 of the suction pipe 107 forms a fluid inlet 116 of the cleaning device 102.

A flow of the fluid through the cleaning device 102 can be driven and the fluid can be subjected to a pressure by means of the pump 108.

A total fluid flow flowing through the cleaning device 102 in a direction of flow 118 is generated in this case.

The pump 108 additionally has a fluid connection to a branch 120 arranged downstream of the pump 108 by means of a supply pipe 121.

The total fluid flow flowing through the cleaning device 102 can be divided into a first component fluid flow and a second component fluid flow by means of the branch 120.

The first component fluid flow of the total fluid flow flowing through the cleaning device 102 can be fed to a fluid passage 122, which forms a first fluid connection between the fluid inlet 116 and a fluid outlet 124 arranged at the nozzle 114.

The first component fluid flow flowing through the fluid passage 122 is referred to below as pulsed fluid flow.

The second component fluid flow of the total fluid flow flowing through the cleaning device 102 can be fed to the bypass 112, which forms a second fluid connection between the fluid inlet 116 and a fluid outlet 124.

The second component fluid flow flowing through the bypass 112 is referred to below as bypass fluid flow.

The bypass fluid flow flowing through the bypass 112 can be combined with the pulsed fluid flow flowing through the fluid passage 122 to form a total fluid flow by means of a junction 126, which is arranged downstream of the fluid passage 122. The total fluid flow can be supplied to the fluid outlet 124 arranged at the nozzle 114.

For this, the cleaning device 102 comprises a nozzle feed pipe 125, which forms a fluid connection between the junction 126 and the fluid outlet 124.

To enable the bypass fluid flow flowing through the bypass 112 to be adjusted with respect to its volume flow, for example, the cleaning device 102 comprises an adjusting device 128 of the bypass 112, which is arranged on the bypass 112, for example.

The adjusting device 128 of the bypass 112 is configured as adjusting screw, for example, to enable a passage cross-section of the bypass 112 and therefore the volume flow of the bypass fluid flow to be easily adjusted.

To be able to adjust the volume flow of the pulsed fluid flow flowing through the fluid passage 122, the cleaning device 102 comprises an adjusting device 130 of the fluid passage 122, which is arranged downstream of the branch 120 and upstream of the pulse valve 110, for example.

The adjusting device 130 of the fluid passage 122 is configured as an adjusting screw, for example, to enable a passage cross-section of the fluid passage 122 and therefore the volume flow of the pulsed fluid flow to be easily adjusted.

Figure 2:
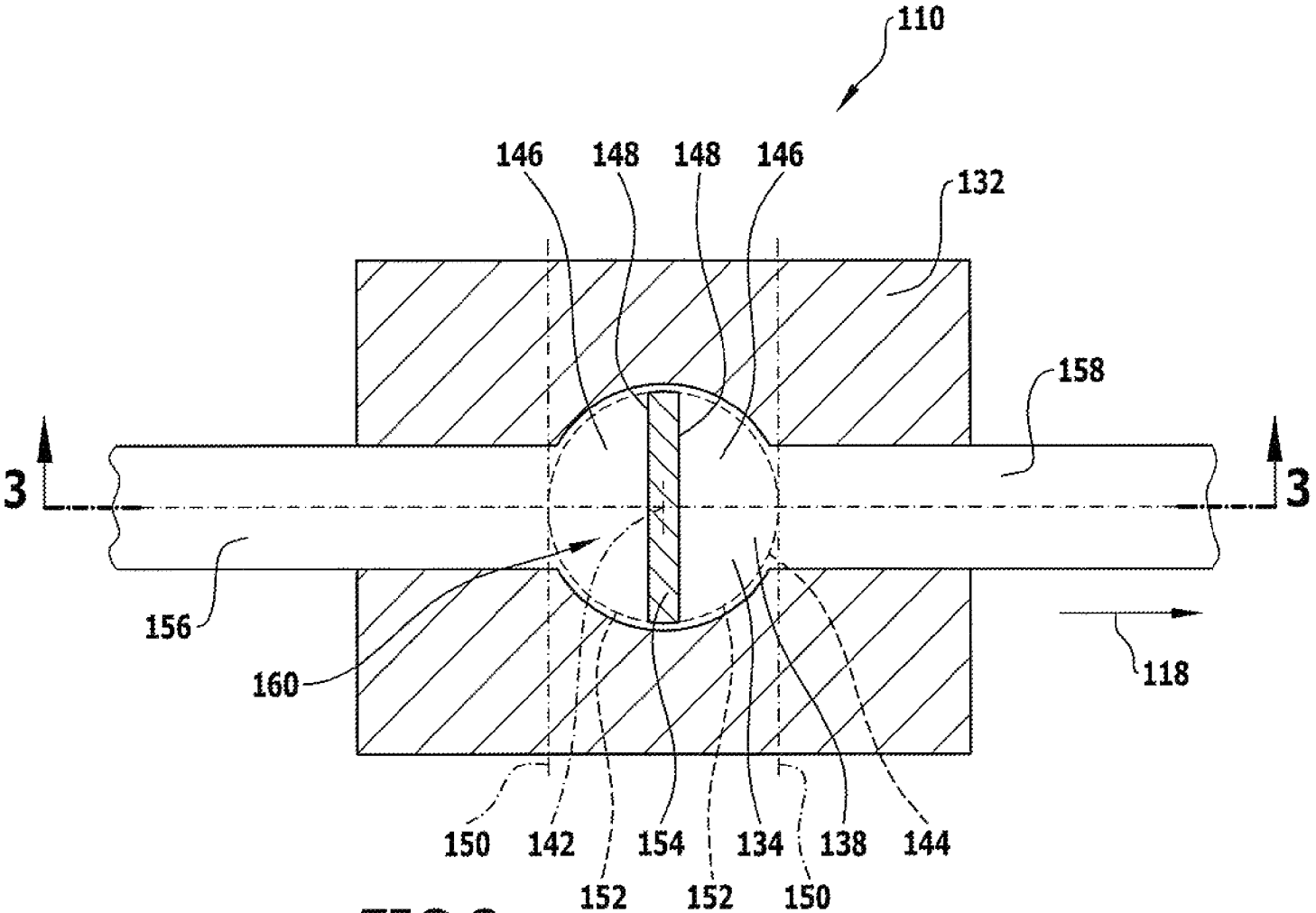
FIG. 2 is a schematic view in longitudinal section through a pulse valve of the device for generating a pulsed jet of a liquid fluid from FIG. 1, in a closed position of the pulse valve.
Figure 3:
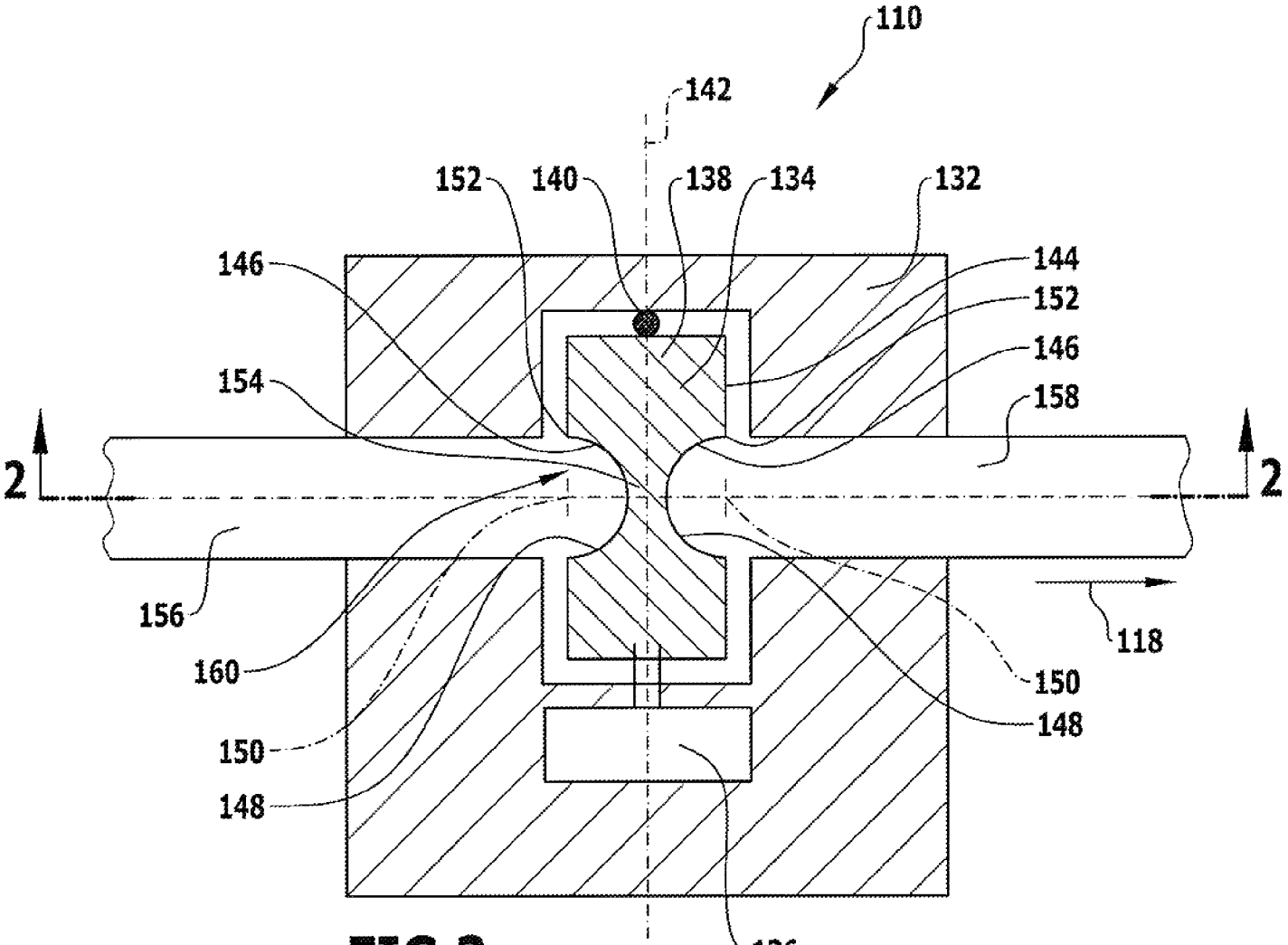
FIG. 3 is a schematic view in longitudinal section perpendicular to the sectional view of FIG. 2 through the pulse valve from FIG. 2, taken along line 3-3 in FIG. 2.

FIGS. 2 and 3 are schematic sectional drawings of the pulse valve 110 during a closing phase, in which the pulsed fluid flow flowing through the fluid passage 122 is interrupted.

The basic structure of such a pulse valve 110 is known from patent document WO 03/036144 A1, for example, to which on this basis reference is made and its content is incorporated into this description.

The pulse valve 110 comprises a housing 132, a blocking element 134 rotatably mounted in the housing 132 and a rotary drive 136 configured as an electric motor, for example, for actuating a rotational movement of the blocking element 134 (see FIG. 3).

The blocking element 134 is configured as a substantially cylindrical shaft 138 and is mounted in the housing 132 of the pulse valve 110 to be rotatable around a rotational axis 142 by means of at least one slide bearing bush 140, for example.

The blocking element 134 has a cylindrical surface of revolution 144 coaxial to the rotational axis 142.

Formed in the surface of revolution 144 of the blocking element 134 are two diametrically opposed recesses 146, which are respectively delimited by a boundary surface 148 in the form of a part cylinder, the cylinder axis 150 of which runs perpendicularly to the rotational axis 142, perpendicularly to the radial direction of the blocking element 134 and tangentially to the surface of revolution 144 of the blocking element 134, and which open along one edge 152 on the surface of revolution 144 of the blocking element 134 (see FIG. 3 in particular).

The recesses 146 are formed in the blocking element 134 by milling out of the initially completely cylindrical blocking element 134 two cylinder-section-shaped segments with the cylinder axes 150 parallel to one another, wherein the cylinder radius is smaller than the radius of the blocking element 134, so that a web region 154 remains between the recesses 146 (see FIG. 3 in particular).

The pulse valve 110 additionally has a pulse valve inlet 156 and a pulse valve outlet 158.

The pulse valve inlet 156 and the pulse valve outlet 158 are connected by a fluid passage 160.

The blocking element 134 is arranged in the fluid passage 160 so that the fluid connection between the pulse valve inlet 156 and the pulse valve outlet 158 can be created and separated cyclically by a rotation of the blocking element 134.

In the closed position of the pulse valve 110 shown in FIGS. 2 and 3 the web region 154 of the blocking element 134 running parallel to the cylinder axes 150 is oriented substantially perpendicularly to the flow direction 118.

Figure 4:
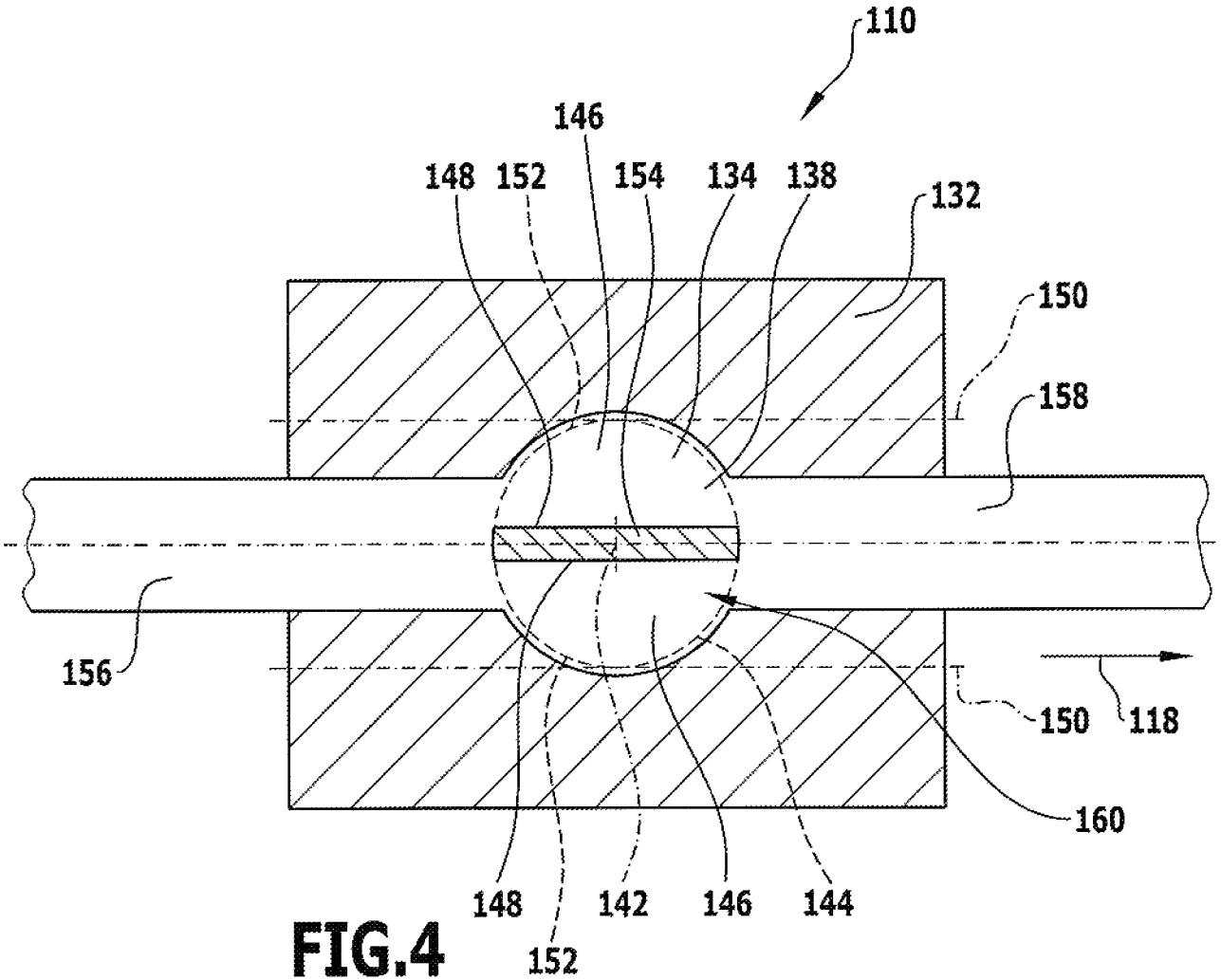
FIG. 4 is a schematic view in longitudinal section corresponding to FIG. 2 through the pulse valve from FIG. 2, in an open position of the pulse valve.

In the open position of the pulse valve 110 shown in FIG. 4 the web region 154 of the blocking element 134 is oriented substantially parallel to the flow direction 118.

The cleaning device 102 described above operates as follows:

Fluid is sucked out of the fluid container 106 through the suction pipe 107 and subjected to pressure by means of the pump 108.

On the one hand, it is favourable if the pressure amounts to at least approximately 3 bar.

On the other hand, the pressure should not be selected to be higher than approximately 300 bar.

Downstream of the pump 108 the total fluid flow flowing through the cleaning device 102 passes through the supply pipe 121 to the branch 120.

By means of the branch 120 the total fluid flow is divided into the pulsed fluid flow that flows through the fluid passage 122 and the bypass fluid flow that flows through the bypass 112.

The volume flow of the pulsed fluid flow flowing through the fluid passage 122 is adjusted by means of the adjusting device 130 of the fluid passage 122.

The volume flow of the bypass fluid flow flowing through the bypass 112 is adjusted by means of the adjusting device 128 of the bypass 112.

The volume flow of the bypass fluid flow flowing through the bypass 112 is substantially constant in time.

The pulsed fluid flow flowing through the fluid passage 122 is cyclically interrupted by means of the pulse valve 110.

An open time, a closed time and/or an opening frequency of the blocking element 134 of the pulse valve 110 is adjusted at the rotary drive 136, for example.

An opening frequency of approximately 2 Hz to approximately 200 Hz is preferably set, wherein a rotational speed of the blocking element 134 is preferably constant in time.

The bypass fluid flow that is substantially constant in time and the pulsating pulsed fluid flow are combined to form the total fluid flow by means of the junction 126.

The total fluid flow passes downstream to the nozzle 114 and leaves the nozzle 114 through the fluid outlet 124.

For example, the workpiece 104 to be cleaned by means of the cleaning device 102 is arranged downstream of the nozzle 114 and spaced therefrom.

The workpiece 104 comprises a cavity 162 to be cleaned, for example, which is subjected to the fluid from the fluid outlet 124.

Because the cavity 162 of the workpiece 104 is constantly subjected at least to the bypass fluid flow flowing through the bypass 112, the cavity 162 of the workpiece 104 is constantly filled with liquid fluid.

Therefore, when the workpiece 104 is cleaned in an atmosphere of air, no air can penetrate into the cavity 162 of the workpiece 104 during the closing phases of the pulse valve 110, in which the pulsed fluid flow flowing through the fluid passage 122 is interrupted.

The removal of contaminants, e.g. metal cuttings, from the cavity 162 of the workpiece 104 by means of the cleaning device 102 is improved as a result of this.

Figure 5:
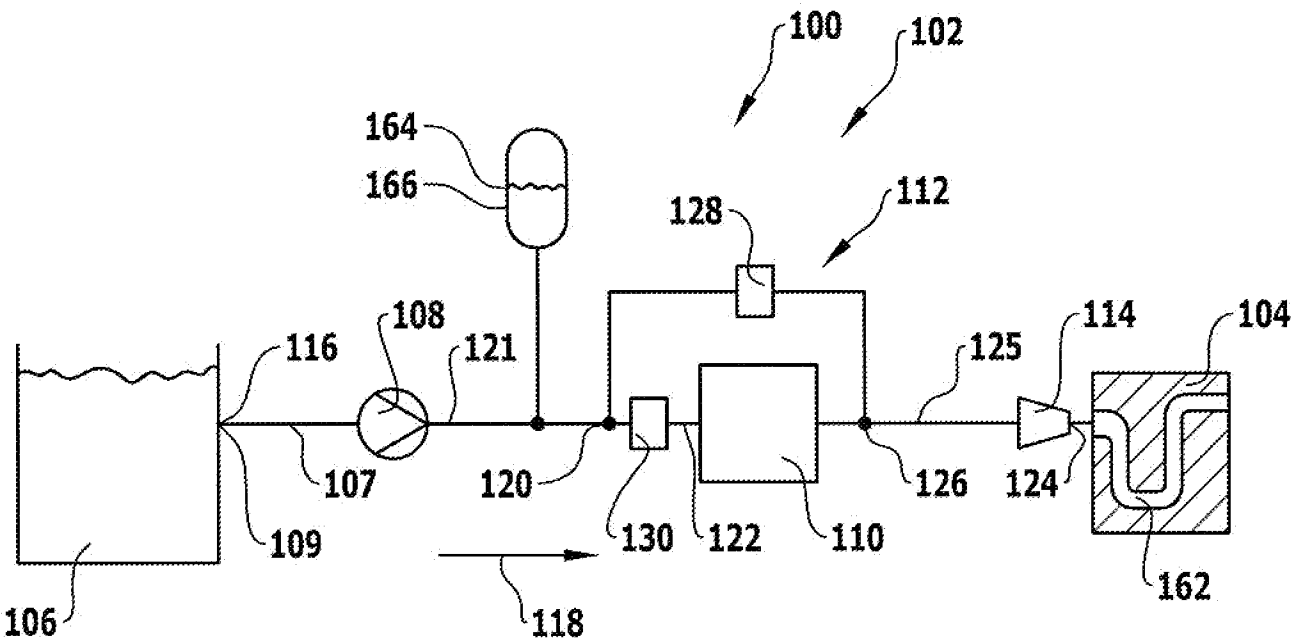
FIG. 5 is a schematic representation of a second embodiment of a device for generating a pulsed jet of a liquid fluid, which has a damping element filled with a compressible fluid for reducing pressure peaks.

A second embodiment of a jet generating device 100 shown in FIG. 5 differs from the first embodiment shown in FIGS. 1 to 4 in that the jet generating device 100 comprises a damping element 164.

Pressure peaks that occur during the closing phases of the blocking element 134 can be damped by means of the damping element 164.

The damping element 164 comprises a container 166, which is substantially tubular, for example, and in an operating state of the jet generating device 100 is filled at least partially with a gas, e.g. nitrogen.

The damping of the damping element 164 is adjustable by selection of the quantity and pressure of the gas.

The container 166 is arranged downstream of the pump 108 and upstream of the branch 120 and has a fluid connection to the supply pipe 121 of the jet generating device 100.

The above-described second embodiment of the jet generating device 100 with the damping element 164 operates as follows:

A strong pressure fluctuation is generated in the jet generating device 100, in particular upstream of the pulse valve 110, by the cyclical opening and closing of the fluid passage 122 by means of the blocking element 134 of the pulse valve 110.

This pressure fluctuation can be reduced by means of the damping element 164.

This occurs because gas located in the container 166 of the damping element 164 is compressed in the case of an increase in the pressure in the jet generating device 100 during the closing phases of the blocking element 134 of the pulse valve 110 and the container 166 of the damping element 164 can receive liquid fluid from the supply pipe 121 of the jet generating device 100.

The pressure generated by means of the pump 108 in the jet generating device 100 is reduced as a result.

During the open phases of the blocking element 134 of the pulse valve 110 the pressure decreases in the jet generating device 100 so that the fluid flows out of the container 166 of the damping element 164 back into the supply pipe 121 of the jet generating device 100 and the gas disposed in the container 166 of the damping element 164 relaxes.

Otherwise, the second embodiment of the jet generating device 100 represented in FIG. 5 is the same with respect to structure and function as the first embodiment represented in FIGS. 1 to 4, and reference is made to the above description thereof on this basis.

Figure 6:
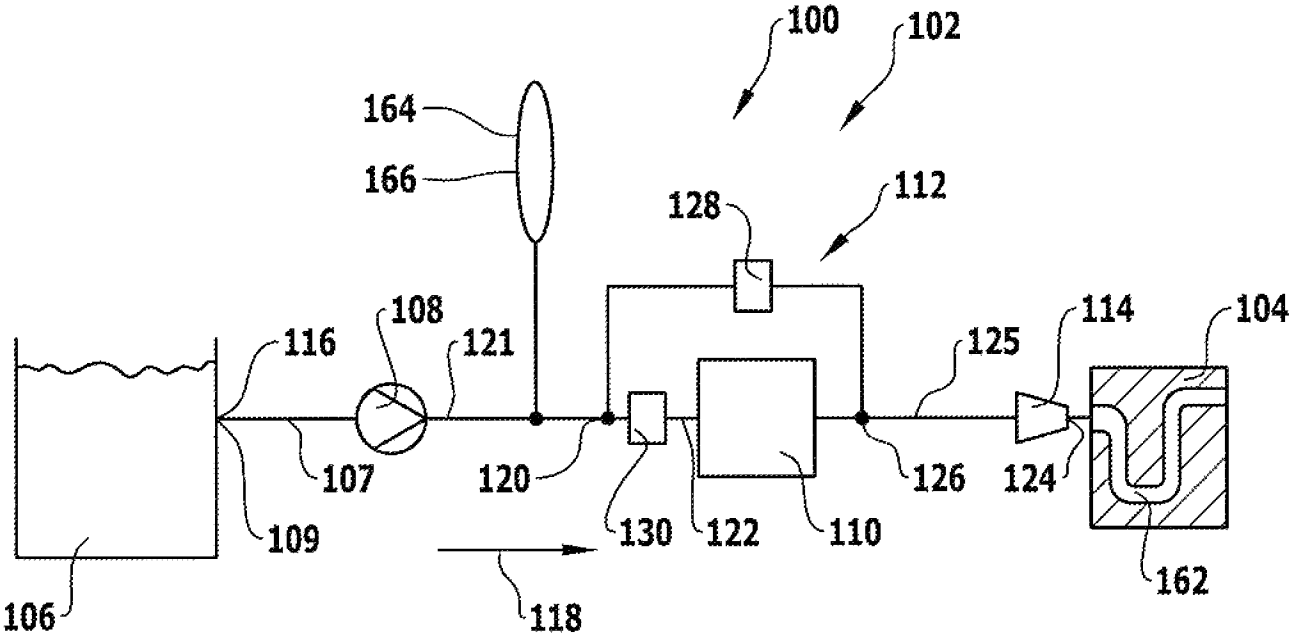
FIG. 6 is a schematic representation of a third embodiment of a device for generating a pulsed jet of a liquid fluid, which has an elastically deformable damping element for reducing pressure peaks, in an open position of the pulse valve.
Figure 7:
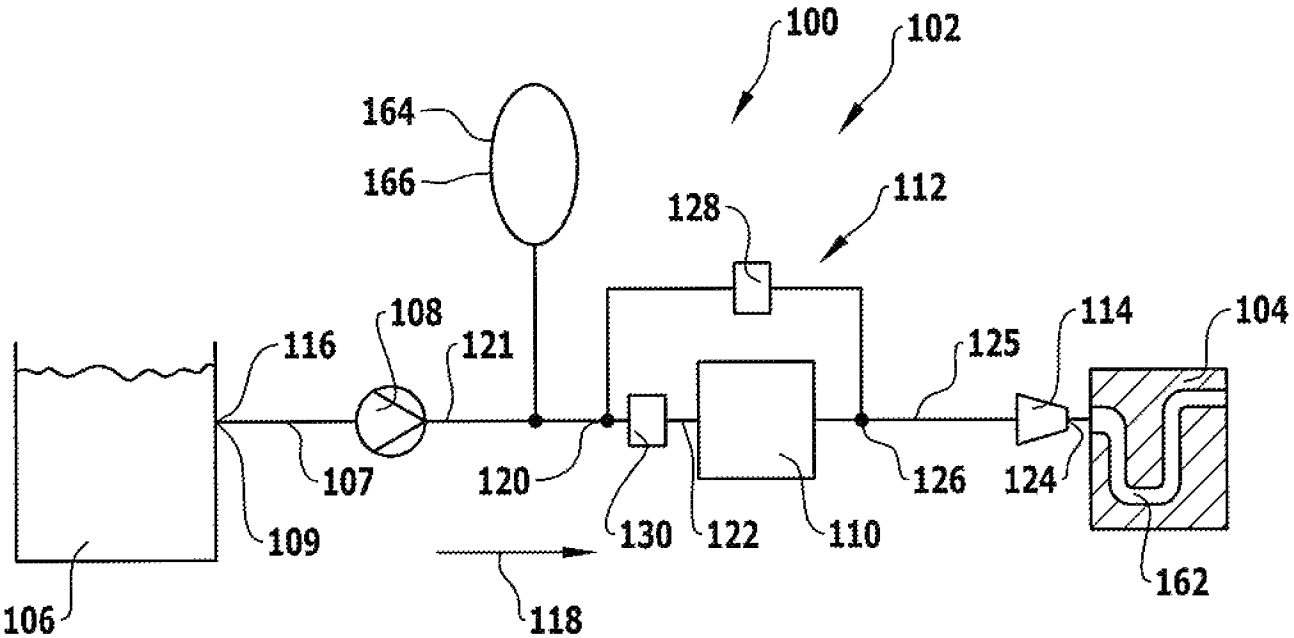
FIG. 7 is a schematic representation of the device for generating a pulsed jet of a liquid fluid from FIG. 6, in a closed position of the pulse valve.

A third embodiment of a jet generating device 100 represented in FIGS. 6 and 7 differs from the second embodiment represented in FIG. 5 in that the container 166 of the damping element 164 is formed from an elastic material.

Preferably, no compressible gas is present in the container 166.

Rather, a damping action of the damping element 164 results during operation of the jet generating device 100 in that during the closing phases of the blocking element 134 of the pulse valve 110 a pressure increase leads to an expansion of the elastically configured container 166 of the damping element 164, and thus to fluid being received in the container 166 of the damping element 164, and finally to the pressure decreasing in the jet generating device 100.

During the open phases of the blocking element 134 of the pulse valve 110 the pressure in the jet generating device 100 decreases, so that the fluid disposed in the container 166 of the damping element 164 flows back into the supply pipe 121 of the jet generating device 100 and the container 166 of the damping element 164 goes back to the relaxed state.

To compare the expansion of the container 166 of the damping element 153 during the open and closing phases of the blocking element 134 of the pulse valve 110, FIG. 6 shows a jet generating device 100 during an open phase of the blocking element 134 of the pulse valve 110 and FIG. 7 shows a jet generating device 100 during a closing phase of the blocking element 134 of the pulse valve 110.

Otherwise, the third embodiment of the jet generating device 100 represented in FIGS. 6 and 7 is the same with respect to structure and function as the second embodiment represented in FIG. 5, and reference is made to the above description thereof on this basis.

Figure 8:
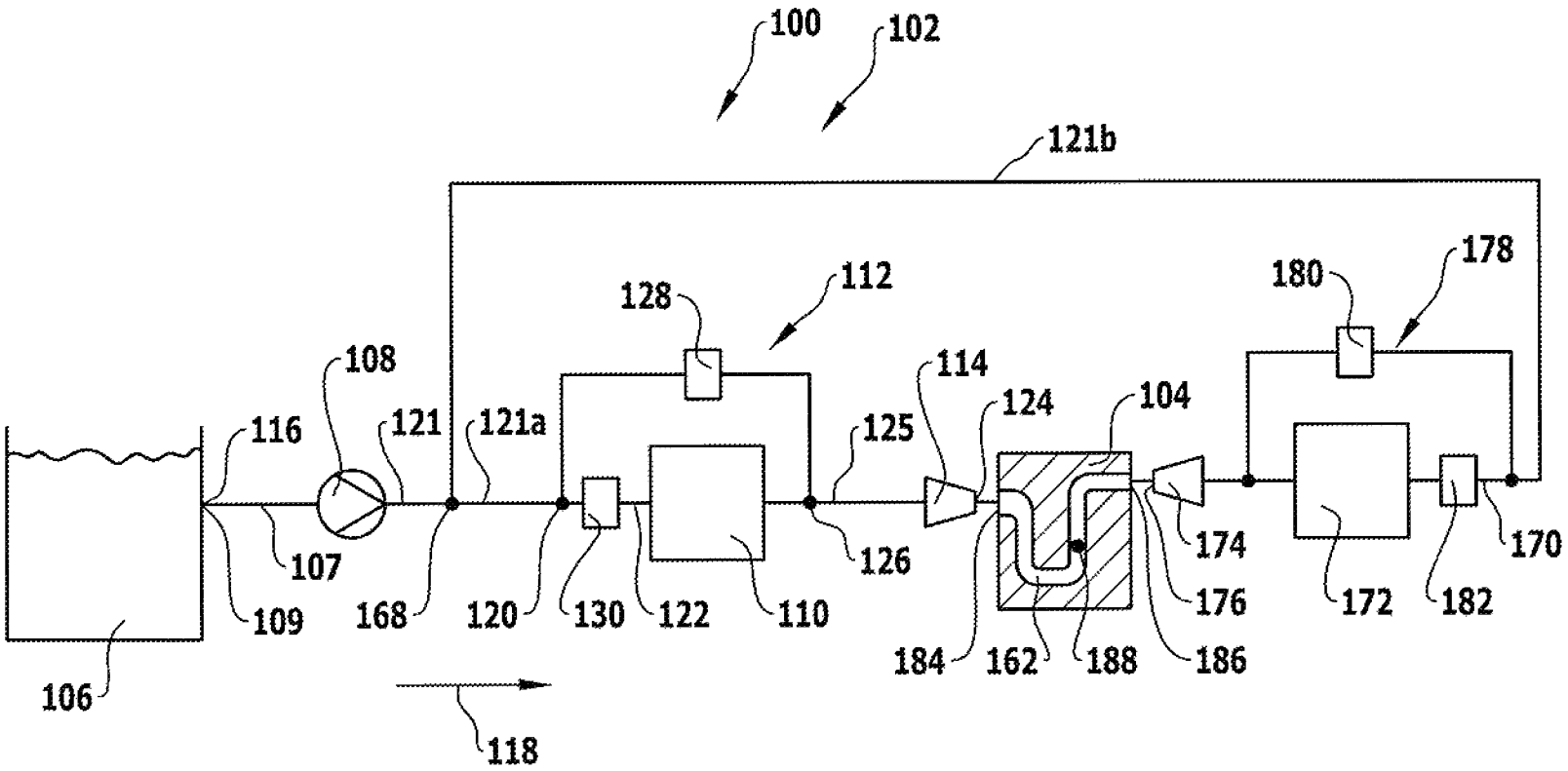
FIG. 8 is a schematic representation corresponding to FIG. 1 of a fourth embodiment of a device for generating a pulsed jet of a liquid fluid, in which a further pulsed jet can be generated.

A fourth embodiment of a jet generating device 100 represented in FIG. 8 differs from the first embodiment represented in FIGS. 1 to 4 in that in addition to the already described pulsed jet (hereafter referred to as "first pulsed jet") at least one second pulsed jet of a liquid fluid can be generated.

For this, the jet generating device 100 comprises a branch 168, which is arranged in the supply pipe 121 between the pump 108 and the branch 120 and divides the fluid flow downstream of the pump 108 into a first supply pipe 121*a* for the first pulsed jet of the liquid fluid and a second supply pipe 121*b* for the second pulsed jet of the liquid fluid.

To generate the two pulsed jets of the liquid fluid, downstream of the first supply pipe 121*a* and downstream of the second supply pipe 121*b* the jet generating device 100 preferably respectively comprises those components that are arranged downstream of the supply pipe 121 in the first embodiment represented in FIGS. 1 to 4.

In particular, the jet generating device 100 thus comprises a second fluid passage 170, which corresponds to the first fluid passage 122 and can be interrupted, in particular cyclically, by means of a second pulse valve 172 corresponding to the first pulse valve 110, a second nozzle 174, which corresponds to the first nozzle 114 and at which a second fluid outlet 176 corresponding to the first fluid outlet 124 is arranged, and a second bypass 178, which corresponds to the first bypass 112 and by means of which fluid can also be fed to the second fluid outlet 176 during closing phases of the second pulse valve 172.

To enable the fluid flow flowing through the second bypass 178 to be adjusted with respect to its volume flow, for example, the jet generating device 100 comprises an adjusting device 180 of the second bypass 178, which corresponds to the adjusting device 128 of the first bypass 112 and is arranged on the second bypass 178.

To enable the fluid flow flowing through the second fluid passage 170 to be adjusted with respect to its volume flow, for example, the jet generating device 100 comprises an adjusting device 182 of the second fluid passage 170, which corresponds to the adjusting device 130 of the first fluid passage 122 and is arranged on the second fluid passage 170.

The components of the jet generating device 100 arranged downstream of the first supply pipe 121*a* and the components arranged downstream of the second supply pipe 121*b* are the same with respect to structure and function as the components of the first embodiment of the jet generating device 100 represented downstream of the supply pipe 121 in FIG. 1 and explained in more detail above with reference to FIGS. 2 to 4, and reference is made to the above description thereof on this basis.

A particularly preferred use of the fourth embodiment of the jet generating device 100 results from the possibility of subjecting the workpiece 104 to the second pulsed jet discharging at the second fluid outlet 176 in addition to the first pulsed jet discharging from the first fluid outlet 124.

In particular, the workpiece 104 can thus be subjected alternately, e.g. from different directions, to pulses of the first pulsed jet and to pulses of the second pulsed jet.

A cavity 162 of the workpiece 104, which is accessible by means of at least two access openings, in particular can be subjected to liquid fluid by means of the jet generating device 100.

For this, the first nozzle 114 is preferably arranged in relation to the workpiece 104 in such a way that the fluid of the first pulsed jet flowing out of the first fluid outlet 124 flows into the cavity 162 of the workpiece 104 through a first access opening 184 of the cavity 162 of the workpiece 104 (see FIG. 8).

In addition, the second nozzle 174 is preferably arranged in relation to the workpiece 104 in such a way that the fluid of the second pulsed jet flowing out of the second fluid outlet 176 flows into the cavity 162 of the workpiece 104 through a second access opening 186 of the cavity 162 of the workpiece 104 (see FIG. 8).

The fluid of the pulses of the first pulsed jet of a liquid fluid and the fluid of the pulses of the second pulsed jet of a liquid fluid preferably flow alternately and in different directions through a region 188 of the cavity 162 of the workpiece 104 that is approximately equidistant from both access openings 184, 186 of the cavity 162. As a result of this, contaminants, e.g. cuttings formed during machining of the workpiece 104, arranged in the cavity 162 of the workpiece 104 are loosened and can be easily removed, in particular flushed out, from the cavity 162 of the workpiece 104.

In this case, the pulse frequency and the flow rate of the first pulsed jet as well as a displacement in time between the exit times of the pulses of the first pulsed jet at the first fluid outlet 124 and the exit times of the pulses of the second pulsed jet at the second fluid outlet 176 are advantageously selected so that the pressure peaks of the pulses of the first pulsed jet reach an end of the cavity 162 of the workpiece 104, in particular the second access opening 186 of the cavity 162 of the workpiece 104, before the pressure peaks of the pulses of the second pulsed jet pass through the second access opening 186 of the cavity 162 of the workpiece 104 into the cavity 162 of the workpiece 104.

Since the time shift between the exit times of the pulses of the first pulsed jet at the first fluid outlet 124 and the exit times of the pulses of the second pulsed jet at the second fluid outlet 176 preferably corresponds to the time shift between the exit times of the pulses of the second pulsed jet at the second fluid outlet 176 and the exit times of the pulses of the first pulsed jet at the first fluid outlet 124, in such a case the pressure peaks of the pulses of the second pulsed jet advantageously also reach an end of the cavity 162 of the workpiece 104, in particular the first access opening 184 of the cavity 162 of the workpiece 104, before the pressure peaks of the pulses of the first pulsed jet pass through the first access opening 184 of the cavity 162 of the workpiece 104 into the cavity 162 of the workpiece 104.

For this, the pulse frequency is preferably always selected so that the transit time of the pressure peaks of the pulses through the cavity 162 of the workpiece 104 is low in relation to the period of the pulse train (reciprocal of the pulse frequency). In this way, the pulses of the first pulsed jet and the pulses of the second pulsed jet are prevented from hindering one another and thus make it more difficult to flush the contaminants out of the cavity 162 of the workpiece 104.

Thus, for instance, a pulse frequency of e.g. approximately 70 Hz, a flow of e.g. 5 l/s and nozzles with a diameter of e.g. 6 mm can be selected.

In this case, a reliable adherence to a desired time shift between the exit times of the pulses of the first pulsed jet at the first fluid outlet 124 and the exit times of the pulses of the second pulsed jet at the second fluid outlet 176 is assured in particular when the rotary drive 136 of the first blocking element 134 of the first pulse valve 110 is synchronised with a rotary drive (not shown) of the second blocking element 192 of the second pulsed valve 172.

To damp the pressure peaks within the jet generating device 100, one or more of the damping elements 164 represented in FIGS. 5 to 7 can be provided in the fourth embodiment of the jet generating device 100.

Otherwise, the fourth embodiment of the jet generating device 100 is the same with respect to structure and function as the first embodiment represented in FIGS. 1 to 4, and reference is made to the above description thereof on this basis.

Figure 9:
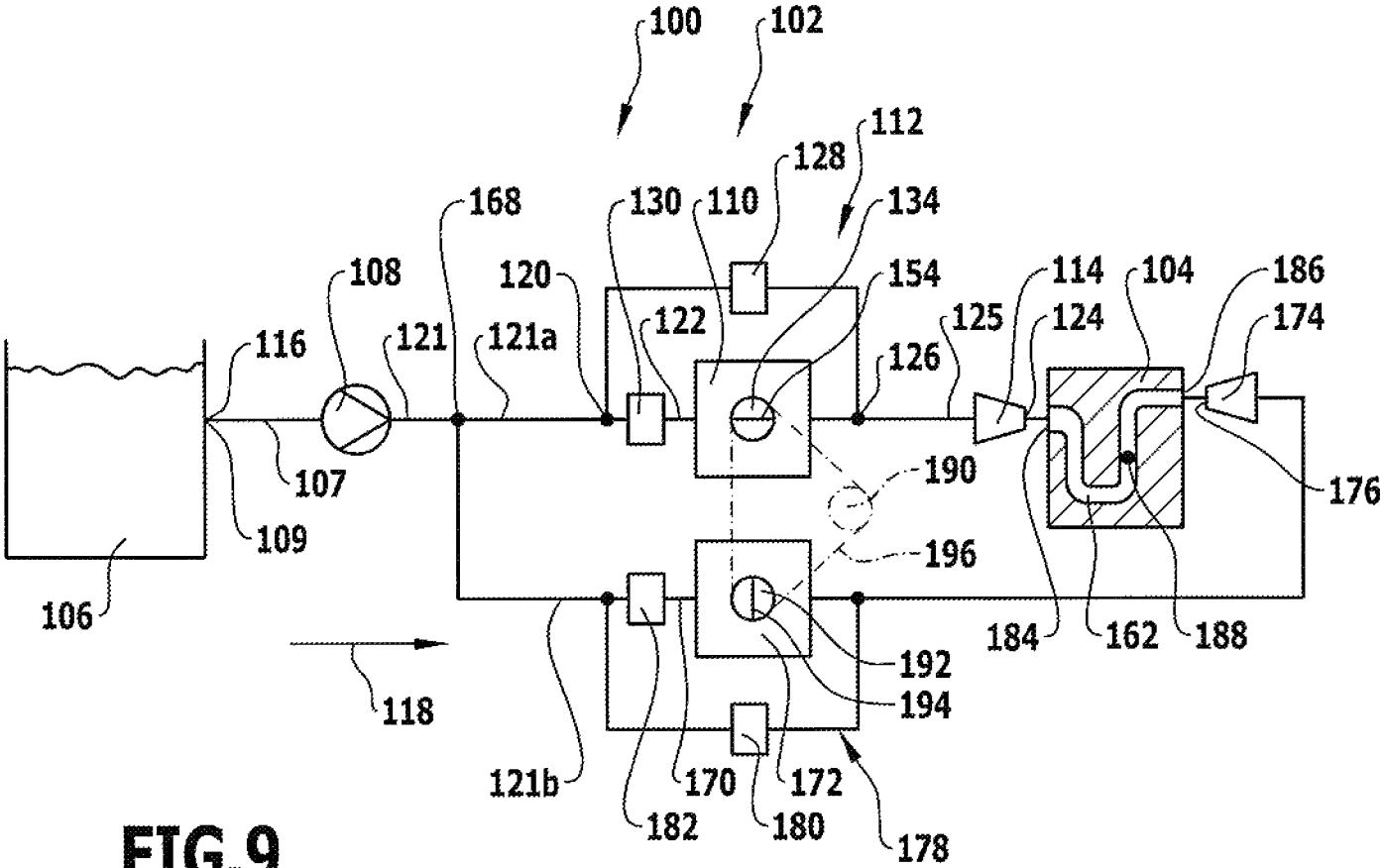
FIG. 9 is a schematic representation corresponding to FIG. 1 of a fifth embodiment of a device for generating a pulsed jet of a liquid fluid, in which two pulsed jets of a liquid fluid can be generated by means of a common drive.

A fifth embodiment of the jet generating device 100 represented in FIG. 9 differs from the fourth embodiment represented in FIG. 8 in that the first pulse valve 110 and the second pulse valve 172 have a common rotary drive 190.

The first blocking element 134 of the first pulse valve 110 and a second blocking element 192 of the second pulse valve 172 are coupled mechanically to one another by means of the common rotary drive 190, so that no separate control is necessary to synchronise the pulses of the first pulsed jet with the pulses of the second pulsed jet.

The mechanical coupling can be achieved by means of a drive belt 196, for example, which is actively connected to the common rotary drive 190, the first blocking element 134 and the second blocking element 192, so that a rotational movement of the common rotary drive 190 can be transmitted to the first blocking element 134 and to the second blocking element 192.

For this, the first pulse valve 110 and the second pulse valve 172 differ from the pulse valve 110 of the first embodiment of the jet generating device 100 shown in FIG. 3 in that instead of having their own rotary drive 136, the first blocking element 134 and the second blocking element 192 respectively have an extension (not shown), on which the drive belt 196 acts.

A specific time shift between the pulses of the first pulsed jet and the pulses of the second pulsed jet can be fixedly set in that before the jet generating device 100 is set in operation a rotational orientation of the first blocking element 134 is set and a rotational orientation of the second blocking element 192 is set independently thereof. The rotational orientations of the first blocking element 134 and the second blocking element 192 are fixed relative to one another as a result of the mechanical coupling by means of the drive belt 196.

On condition that the same transmission ratio occurs between a rotational movement of the common rotary drive 190 and the rotational movement of the first blocking element 134 as well as between the rotational movement of the common rotary drive 190 and the rotational movement of the second blocking element 192, the first blocking element 134 and the second blocking element 192 rotate at the same frequency and thus retain the previously set rotational orientation in relation to one another.

Because of the freely selectable rotational orientation of the blocking elements 134, 192, a displacement between the exit times of the pulses of the first pulsed jet at the first fluid outlet 124 and the exit times of the pulses of the second pulsed jet at the second fluid outlet 176 is freely selectable. In particular, this displacement is freely selectable between approximately zero and e.g. approximately the period of the pulse train (corresponding to half the reciprocal of the rotation frequency of the blocking elements 134, 192).

In addition, the common rotary drive 190 renders a separate rotary drive for the second blocking element 192 of the second pulse valve 172 unnecessary.

In the fifth embodiment of the jet generating device 100 an alternating delivery of pulses of the first pulsed jet and pulses of the second pulsed jet is possible in particular when the first blocking element 134 and the second blocking element 192 are coupled to the common rotary drive 190 in such a way that the first web region 154 of the first blocking element 134 is constantly oriented substantially parallel to the flow direction 118 when a second web region 194 of the second blocking element 192 is oriented substantially perpendicularly to the flow direction 118 (see FIG. 9). The angle difference between the rotational orientation of the first blocking element 134 and the rotational orientation of the second blocking element 192 then amounts to 90°.

Otherwise, the fifth embodiment of the jet generating device 100 represented in FIG. 9 is the same with respect to structure and function as the fourth embodiment represented in FIG. 8, and reference is made to the above description thereof on this basis.

In particular, in the fifth embodiment of the jet generating device 100 represented in FIG. 9 it can thus also be provided that the jet generating device 100 comprises one or more of the damping elements 164 represented in FIGS. 5 to 7.

An improved mechanical action on an object subjected to the pulsed jet is possible because in each of the above-described embodiments at least a portion of the fluid flow flowing through the jet generating device 100 can constantly be fed to the workpiece 104.

The invention claimed is:

1. Process for subjecting a workpiece to a pulsed jet of a liquid fluid using a first device for generating a pulsed jet of a liquid fluid, the process comprising the following:

generating pulses of the pulsed jet by cyclically interrupting a fluid flow through a fluid passage between a fluid inlet and a fluid outlet using a blocking element;

subjecting the workpiece to the pulses of the pulsed jet;

subjecting the workpiece to a bypass fluid flow of the fluid flowing through a bypass, which is configured to feed the fluid to the fluid outlet during a closing phase of the blocking element;

wherein a volume flow of the bypass fluid flow flowing through the bypass is smaller than a volume flow of a pulsed fluid flow flowing through the fluid passage.

2. Process according to claim 1, wherein pressure peaks occurring during the cyclical interruptions of the fluid flow through the fluid passage are reduced using a damping element.

3. Process according to claim 2, wherein the damping element is at least partially filled with a compressible gaseous fluid in an operating state of the first device.

4. Process according to claim 2, wherein the damping element comprises an elastic region formed from an elastic material which is deformed when a pressure of the gaseous fluid raises above a limit pressure.

5. Process according to claim 1, wherein the workpiece is subjected to at least one further pulsed jet of a liquid fluid from a second device for generating a pulsed jet of a liquid fluid.

6. Process according to claim 5, wherein the pulses of a first pulsed jet from the first device are staggered in time in relation to the pulses of a second pulsed jet from the second device.

7. Process according to claim 6, wherein the workpiece is alternately subjected to pulses of a first pulsed jet and to pulses of a second pulsed jet.

8. Process according to claim 7, wherein a cavity of the workpiece is alternately subjected to pulses of a first pulsed jet of a liquid fluid flowing through a first access opening of the cavity and to pulses of a second pulsed jet of a liquid fluid flowing through a second access opening of the cavity.

9. Process according to claim 5, wherein a region of a cavity of the workpiece is subjected to the pulses of a first pulsed jet of a liquid fluid and to the pulses of a second pulsed jet of a liquid fluid in such a manner that the fluid from the first pulsed jet and the fluid from the second pulsed jet flow through the region of the cavity of the workpiece in different directions.

10. Process according to claim 5, wherein the first device and the second device are fluidly coupled to a fluid container.

11. Process according to claim 1, wherein the volume flow of the bypass fluid flow flowing through the bypass is adjusted using a bypass fluid flow adjusting device arranged on the bypass.

12. Process according to claim 1, wherein the volume flow of the pulsed fluid flow flowing through the fluid passage is adjusted using a pulsed fluid flow adjusting device.

13. Process according to claim 1, wherein a total fluid flow flowing through the first device is divided into the pulsed fluid flow flowing through the fluid passage and the bypass fluid flow flowing through the bypass so that the volume flow of the bypass fluid flow amounts to at most approximately 10% of the volume flow of the total fluid flow.

14. Process according to claim 1, wherein the first device comprises at least two fluid outlets and at least two blocking elements, wherein a first blocking element cyclically closes and opens a first fluid passage, so that a first pulsed jet of a liquid fluid is generated at a first fluid outlet, and wherein a second blocking element cyclically closes and opens a second fluid passage, so that a second pulsed jet of a liquid fluid is generated at a second fluid outlet.

15. Process according to claim 14, wherein the first device comprises a common drive for driving the first and second blocking elements or at least two drives synchronised to one another for driving the first and second blocking elements, wherein the common drive or the at least two drives are operated so that the closing and open phases of the first blocking element are staggered in time in relation to the closing and open phases of the second blocking element.

16. Use of a device for generating a pulsed jet of a liquid fluid, said device comprising a fluid inlet, a fluid outlet and a blocking element arranged between the fluid inlet and the fluid outlet, which cyclically closes and opens a fluid passage between the fluid inlet and the fluid outlet, wherein the device comprises at least one bypass, through which a liquid fluid can also be fed to the fluid outlet during a closing phase of the blocking element, for cleaning a workpiece, using a process for subjecting the workpiece to the pulsed jet of the liquid fluid, comprising the following:

generating pulses of the pulsed jet by cyclically interrupting a fluid flow through the fluid passage;

subjecting the workpiece to the pulses of the pulsed jet;

subjecting the workpiece to a bypass fluid flow of the fluid flowing through the bypass during the cyclical interruptions of the fluid flow through the fluid passage;

wherein a volume flow of the bypass fluid flow flowing through the bypass is smaller than a volume flow of a pulsed fluid flow flowing through the fluid passage.

* * * * *